United States Patent [19]

Carlisle

[11] 4,172,152

[45] Oct. 23, 1979

[54] THERMALLY INSULATIVE BEVERAGE CONTAINER

[76] Inventor: Richard S. Carlisle, P.O. Box 307, Rye, N.Y. 10580

[21] Appl. No.: 823,991

[22] Filed: Aug. 12, 1977

Related U.S. Application Data

[63] Continuation-in-part of Ser. No. 678,730, Apr. 21, 1976, abandoned, which is a continuation of Ser. No. 444,321, Feb. 21, 1974, abandoned.

[51] Int. Cl.[2] ..... B65B 31/02

[52] U.S. Cl. ..... 426/127; 53/434; 53/449; 229/55; 426/106; 426/115; 426/410; 426/415; 220/426; 220/460; 220/461

[58] Field of Search ..... 426/106, 112, 115, 410, 426/415, 127; 229/55; 53/22 B, 27; 220/426, 460, 461

[56] References Cited

U.S. PATENT DOCUMENTS

| | | | |
|---|---|---|---|
| 2,135,479 | 11/1938 | Berch | 426/124 X |
| 2,344,369 | 3/1944 | Salfisberg | 229/56 UX |
| 2,713,543 | 7/1955 | Peters | 53/22 B |
| 2,721,691 | 10/1955 | Makrauer | 229/55 |
| 2,954,901 | 10/1960 | Winstead | 229/14 B |
| 3,098,560 | 7/1963 | Skees | 426/129 X |
| 3,190,441 | 6/1965 | Rausing | 229/55 X |
| 3,193,392 | 7/1965 | Lundquist et al. | 426/124 |
| 3,248,040 | 4/1966 | Friedman | 229/55 |
| 3,340,669 | 9/1967 | Farquharson | 206/521 X |
| 3,389,823 | 6/1968 | Finzi et al. | 220/9 LG |
| 3,574,642 | 4/1971 | Weinke | 426/124 |
| 3,620,774 | 11/1971 | Ford et al. | 229/55 X |
| 3,630,759 | 12/1971 | Rumberger | 426/124 |
| 3,675,809 | 7/1972 | McGrew et al. | 220/9 LG |
| 3,677,774 | 7/1972 | Rausing | 426/396 X |
| 3,681,092 | 8/1972 | Titchenal et al. | 426/415 X |

*Primary Examiner*—Steven L. Weinstein

[57] ABSTRACT

A container structure for carbonated beverages is described formed of a multiple wall structure having an inner wall and an outer wall. The inner wall is formed of a material through which a gas such as carbon dioxide from the retained beverage can migrate and become trapped in a chamber between the inner and outer walls. The outer wall is formed of a material which is sufficiently impervious to carbon dioxide so that a gaseous thermally insulative chamber is maintained around the inner wall. The inner and outer walls may be formed of thin heat sealable sheet material to provide a flexible thermally insulated carbonated beverage container.

19 Claims, 4 Drawing Figures

Fig. 1.
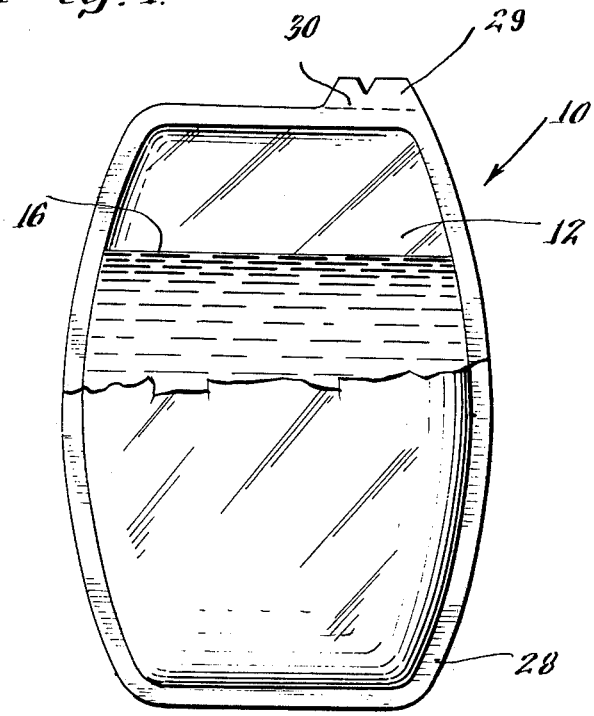
Fig. 2.
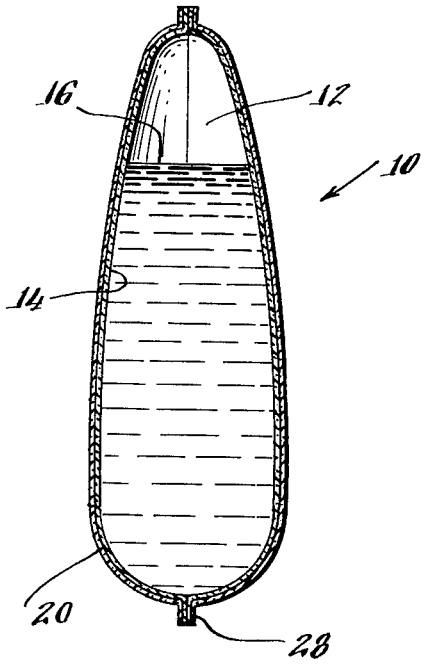
Fig. 3.
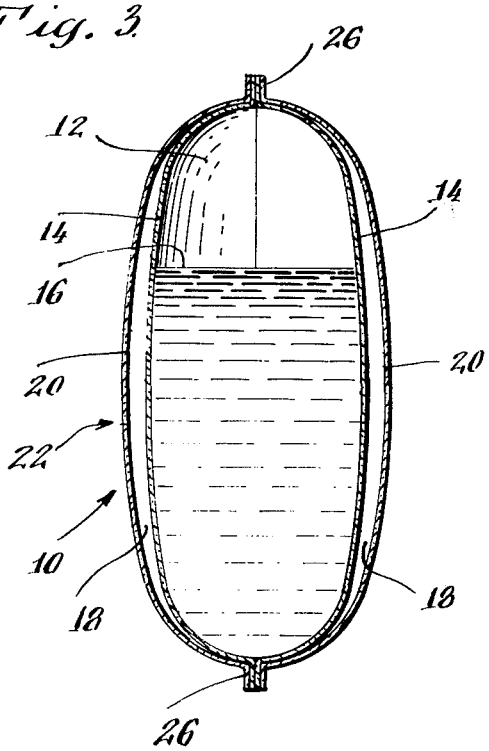
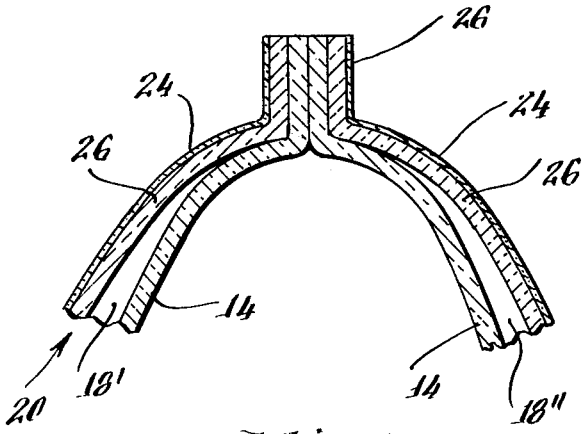
Fig. 4.

THERMALLY INSULATIVE BEVERAGE CONTAINER

This is a continuation-in-part of my patent application Ser. No. 678,730, filed Apr. 21, 1976 and entitled "A Thermally Insulative Beverage Container", now abandoned, which was a continuation of Ser. No. 444,321, filed Feb. 21, 1974, now abandoned.

FIELD OF THE INVENTION

This invention relates to a flexible container structure for beverages. More specifically, this invention relates to a flexible package for carbonated beverages with thermal insulation.

BACKGROUND OF THE INVENTION

Flexible containers for retaining beverages are known in the art. Note, for example, my co-pending patent application entitled "Plastic Film Containers With Self-Sealing Orifices" and filed on Mar. 2, 1972 in the U.S. Patent and Trademark Office with Ser. No. 231,228 now U.S. Pat. No. 3,815,794.

SUMMARY OF THE INVENTION

A container structure in accordance with the invention contemplates a compound wall device formed of an inner container and an outer container. The inner container is formed with a wall material which retains the liquid beverage, but permits a gas such as carbon dioxide from a carbonated beverage to pass through the inner container wall and lodge between the inner and outer container. The outer container has a wall structure formed of a material which retains the gas (or may be capable of retaining both the beverage and the gas) to thus permit the formation of a gaseous chamber around the liquid in the inner container for thermal protection. The container structure is conveniently formed of flexible thin-walled materials to enable convenient use of heat sealing in the assembly of the structure, and form a flexible structure for ease of storage (and disposal).

The gaseous thermally insulative barrier is produced by gas escaping from the inner container and thus is conveniently self-produced. The insulative quality of the thermal barrier is sufficient to preserve the refreshing coolness of a refrigerated beverage for a time period considered adequate for many applications.

It is, therefore, an object of the invention to provide a multiple walled container, capable of forming its own thermally protective barrier.

BRIEF DESCRIPTION OF DRAWINGS

These and other advantages and objects of the invention can be understood from the following detailed description of a preferred embodiment described in conjunction with the drawings wherein FIG. 1 is a front view of a container in accordance with the invention;

FIG. 2 is a side section view of the container shown in FIG. 1 before formation of a thermally protective barrier;

FIG. 3 is a side section view of the container shown in FIG. 1 after formation of a thermal protection barrier; and FIG. 4 is an enlarged partial side section view of the heat-sealed segment of the container shown in FIG. 1.

DETAILED DESCRIPTION OF EMBODIMENT

With reference to the Figures, a carbonated beverage container structure 10 is shown in accordance with the invention. The container structure 10 includes an inner container 12 formed with an inner wall 14 of a thin flexible material selected to be capable of retaining a beverage 16 while permitting a gas such as carbon dioxide to pass through. A typical material for wall 14 may be a thin sheet of polyethylene material. Polyethylene has good moisture barrier properties and thus is capable of retaining the beverage. However, polyethylene does permit carbon dioxide emitted by the carbonated beverage 16 to pass through wall 14 and enter the space 18 between the inner wall 14 and the outer wall 20 of an outer container 22. Polypropylene and other polyolefins and copolymers of polyolefins are also suitable as inner wall 14 material.

The outer container 22 is formed with a wall material which is relatively impervious to a gas such as carbon dioxide in comparison with the inner wall 14. The carbon dioxide thus is trapped in chamber 18 between the inner wali 14 and outer wall 20. The carbon dioxide filled chamber 18 forms a thermal barrier for beverage 16 in inner container 12.

The carbon dioxide develops substantial pressure in chamber 18 and thus a mechanically protective cushion is provided. Further, even if the outer wall 20 should become punctured, the beverage will still be contained by the inner container 12.

The outer wall 20 may be formed of a number of different materials such as a laminate composed of an outer layer 24 of a sheet of nylon and/or a layer of polyethylene teraphthalate and/or a vinyl layer such as Saran, and an inner layer 26 of a polyolefin such as polyethylene or polypropylene or a copolymer. The inner layer 26 is preferably a material suitable for forming a heat seal with the inner wall 14. Such laminated outer wall 22 may be formed by adhesive bonding or extrusion laminating techniques.

In order to retain flexibility of the package 10 along with sufficient strength in the outer wall 20 to withstand the pressure from the retained carbon dioxide, outer wall 20 should have a thickness of about 6 mils for a 10 oz. liquid capacity and generally less than 10 mils. In such case the laminate outer wall 20 may be formed with outer layer 24 of nylon of about 0.5 to 1 mil thick and with inner layer 26 of polyethylene of 5 to 9 mils thick. The thickness of the nylon film is selected to be sufficient to provide a desired imperviousness to carbon dioxide while maintaining a flexible structure. Generally most simplex (non-laminated) films under 10 mils of thickness tend to lose carbon dioxide over time periods of from two days to nine months. However, satisfactory carbon dioxide retention can be obtained with a laminated film having a nylon or Saran outer layer 24.

The inner wall 14 for container 10 may be formed of a sheet of polyethylene of a thickness of about 2 mils and generally less than 4 mils with the thickness of wall 14 being primarily selected on the basis of the amount of beverage to be retained and the speed by which the carbon dioxide is to migrate through wall 14.

In the formation of package 10, the polyethylene inner wall 14 and layer 26 are heat-sealed to each other at the peripheral edges 28 of the container structure. The heat-sealed edges 28 separate thermal barrier chamber 18 into two separated compartments 18' and 18'' (see FIG. 4) on opposite sides of the inner container wall 14. These compartments generally cooperate to surround the inner container to form the desired structure which permits the gradual formation of a thermal barrier when the inner container is filled with a carbonated beverage. This barrier formation occurs over a time period of no more than three days. Although a small amount of trapped air may occur between the walls 14 and 20 before filling, this trapped air is insignificant with respect to formation of an effective thermal barrier. This is because walls 14 and 20 become initially tightly forced together a few minutes after insertion of the carbonated beverage. The walls would remain together were it not for the following process: as soon as carbon dioxide commences to permeate through inner wall 14 and enters the chambers 18 between the walls 14 and 20, they commence to self separate.

The formation of a carbon dioxide thermal barrier 18 commences soon after a carbonated beverage has been placed in the inner container 12 and the peripheral edge 28 has been sealed. The thermal barrier continues to expand resulting finally in separating the inner and outer walls 14 and 20 so as to provide a spaced relationship generally as shown in FIG. 3. The inner wall 14 and the outer wall 20 soon after filling and sealing, usually within several minutes, are both stressed as a result of the internal carbon dioxide pressure. The stress tends to force the inner wall initially outward against the outer wall 20. Then, gradually over a time period of from several hours to three days the inner wall assumes the position as shown in FIG. 3, as carbon dioxide permeates through wall 14 to accumulate between it and the outer wall 20. In this manner the walls 14 and 20 can be said to self separate.

The thermal barrier 18 usually is completed well in advance of the time the package is available to the consumer. Typically, the thermal barrier is completely formed in a time period measured from several hours to no more than about three days.

A carbonated beverage is placed in the inner container formed by wall 14, then an upper segment 29 is scored along dashed line 30 to provide a tear tab for convenient opening of the container 10.

As an alternate construction, part of the periphery 28 could consist of a fold, thus providing a single insulating chamber. For example, the container can be formed of two layers of films 14, 20 folded along an approximate center line with the two upright edges heat sealed to enable filling through the remaining open third edge. This latter edge is heat sealed closed after filling with the carbonated beverage. The beverage then is inside inner container wall 14 which is fully surrounded by a carbon dioxide impervious outer wall 20.

When the beverage 16 in the container 10 is to be cooled, the thermal barrier 18, normally formed around the inner container 12, retards the refrigeration. When package 10 has the shape of a generally rounded body portion with a tapered relatively narrow extended spout segment, as described in the aforementioned patent application, the formation of a thermal barrier is normally inhibited at the spout segment. This segment is formed by closely spaced heat seals about one to three inches in length and one-half to one inch apart. These closely spaced seals tend to effectively prevent the self separation of the walls in the spout and thus, the formation of an effective thermal barrier in the spout region.

One can take advantage of the absence of the thermal barrier around such a narrow spout segment by placing the container upside down in the refrigerator and thus bringing the beverage 16 in better thermal contact with the cooled environment. When package 10 is again placed upright, its refrigerated temperature thereafter normally tends to be maintained by the gaseous thermal barrier 18.

Having thus described a flexible thin walled beverage container structure in accordance with the invention, its many advantages may be appreciated. The self-formation of the thermal barrier may also be used to advantage in containers having a semi-rigid outer wall material which is relatively impervious to carbon dioxide and with an inner flexible wall container 14 such as described herein. An example of a suitable semi-rigid outer wall material would be 6 mil thick polyethylene teraphthalate.

What is claimed is:

1. A container of liquid, including a quantity of liquid containing absorbed gas under pressure, opposed films joined to each other by a peripheral seam forming a sealed inner container newly containing the liquid, said films being formed of material pervious to the gas but not to the liquid, a pair of outer walls against said inner container and opposite to and coextensive with said films and sealed thereto peripherally, said films and outer walls being readily movable away from each other over almost all of the area thereof so that the confronting films and outer walls form a pair of sealed outer compartments, said outer walls being formed of material selected for its relative imperviousness to said gas in contrast to the perviousness of said films to said gas, such that gas from the liquid can permeate said films and accumulate under pressure higher than that of the ambient atmosphere in said compartments which causes separation of the outer walls from the inner container over at least nearly all of the area thereof, the compartments then serving as cushioning thermally insulating barriers.

2. A container as in claim 1, said films being selected for sufficient perviousness to said gas so that gas from the liquid accumulates in said sealed outer compartments under higher than ambient pressure in about three days after the inner container is newly filled with said liquid.

3. An individual thermally insulated container of carbonated beverage comprising an inner wall defining a sealed beverage container, said inner wall being formed of sheet material which is pervious to carbon-dioxide and essentially impervious to liquid, a carbonated beverage containing carbon-dioxide under pressure in said beverage container, an outer wall of sheet material coacting with said inner wall to form sealed compartment means at least largely enclosing said sealed beverage container, said inner and outer walls having opposed extensive areas adapted to be generally spaced apart for containing gas under pressure, the material of said outer wall being highly impervious to carbon-dioxide in contrast to the carbon-dioxide perviousness of the material of the inner wall, whereby the sealed compartment means can contain carbon-dioxide under pressure derived from the carbonated beverage, the compartment means when in that condition providing thermal insulation between the beverage and the ambient atmosphere.

4. The container as claimed in claim 3 wherein at least a layer of the outer wall is formed of polyethylene teraphthalate.

5. The container of carbonated beverage as claimed in claim 3 wherein the outer wall is formed of a laminate structure formed of an innermost layer impervious to the beverage and heat sealable to the inner wall and a further layer formed of a pair of layers of different materials selected from the group consisting of nylon, Saran, and polyethylene teraphthalate.

6. A container as in claim 3 wherein the inner and outer walls have peripheral edges all sealed together, dividing said compartment means into a pair of individually sealed compartments.

7. A container as in claim 3, wherein said compartment means contains carbon-dioxide under higher than ambient pressure.

8. A container as in claim 3 wherein said beverage is newly present in said beverage container and wherein said inner and outer walls are essentially together, whereby carbon-dioxide from the beverage can penetrate the carbon-dioxide pervious inner wall and accumulate under pressure in said compartment means.

9. A container as in claim 3, wherein the inner wall and the outer wall are sheets of material sealed to each other along seams and defining the sealed compartment means having plural separately sealed thermally insulating cushioning chambers.

10. A container as in claim 3 wherein said inner wall is selected for sufficient perviousness to said gas so that gas from the beverage accumulates in said sealed compartment means under higher than ambient pressure in about three days after the inner container is newly filled with said liquid.

11. An individual thermally insulated container as in claim 3, wherein said inner and outer walls are joined by seams dividing said compartment means into multiple compartments.

12. The container of carbonated beverages as claimed in claim 3 wherein the outer wall is formed of a laminate structure having a layer of said material which is highly impervious to carbon dioxide.

13. The container as claimed in claim 12 wherein said layer of the outer wall is formed of nylon.

14. The container as claimed in claim 12 wherein said layer of the outer wall is formed of Saran.

15. The container as claimed in claim 12 wherein said highly impervious layer has a thickness of about 0.5 to 1.0 mils.

16. The method of producing a thermally insulated container of liquid, including the steps of introducing a liquid containing a high-pressure gas into a liquid-containing chamber of a double-walled container and sealing the chamber, the container having an inner wall constituting said chamber and being made of sheet material pervious to the gas and impervious to the liquid and said container having an outer wall coacting with said inner wall to constitute sealed compartment means at least largely enclosing said chamber, and said outer wall being formed of material that is relatively impervious to the gas in contrast to the perviousness of the inner wall to the gas, the inner and outer walls being readily movable away from each other over at least most of the area thereof but being together when the container initially receives the liquid, and storing the container while gas from the liquid penetrates said inner wall and develops pressure higher than ambient in said compartment means.

17. A thermally insulated container of liquid made by the method of claim 16.

18. A method of producing a thermally insulated container of liquid as in claim 16, wherein said liquid is a carbonated beverage.

19. A thermally insulated container of carbonated beverage made by the method of claim 18.

* * * * *